US009212425B2

(12) United States Patent
Eerden et al.

(10) Patent No.: US 9,212,425 B2
(45) Date of Patent: Dec. 15, 2015

(54) ARTICLE HAVING A RELATIVELY SOFT SUPPORT MATERIAL AND A RELATIVELY HARD DECORATIVE LAYER AND ALSO A METHOD FOR ITS MANUFACTURE

(75) Inventors: Michiel Eerden, Geldrop (NL); Jeroen Landsbergen, Best (NL); Paul Peeters, Eindhoven (NL); Christian Strondl, Venlo (NL); Roel Tietema, Venlo (NL)

(73) Assignee: IHI HAUZER TECHNO COATING B.V., Venlo (NL)

( * ) Notice: Subject to any disclaimer, the term of this patent is extended or adjusted under 35 U.S.C. 154(b) by 1519 days.

(21) Appl. No.: 12/087,824

(22) PCT Filed: Jan. 5, 2007

(86) PCT No.: PCT/EP2007/000075

§ 371 (c)(1),
(2), (4) Date: Mar. 26, 2009

(87) PCT Pub. No.: WO2007/082645

PCT Pub. Date: Jul. 26, 2007

(65) Prior Publication Data

US 2009/0202790 A1 Aug. 13, 2009

(30) Foreign Application Priority Data

Jan. 13, 2006 (DE) ..... 10 2006 001 860
Jan. 16, 2006 (DE) ..... 10 2006 002 034

(51) Int. Cl.
*B32B 3/10* (2006.01)
*C23C 28/00* (2006.01)

(52) U.S. Cl.
CPC ..... *C23C 28/00* (2013.01); *C23C 28/322* (2013.01); *C23C 28/34* (2013.01); *C23C 28/341* (2013.01);
(Continued)

(58) Field of Classification Search
USPC ..... 428/195.1, 209; 427/249.7, 569; 204/298.16
See application file for complete search history.

(56) References Cited

U.S. PATENT DOCUMENTS 4,847,135 A * 7/1989 Braus et al. ..... 428/138
4,992,153 A * 2/1991 Bergmann et al. ..... 204/192.16
(Continued)

FOREIGN PATENT DOCUMENTS

DE 29613494 U1 * 11/1997
DE 100 11 597 A1 3/2000
(Continued)

OTHER PUBLICATIONS

Machine_English_Translation; Fussel; Bearing for door handle has split shell slid over retaining flange and position on door handle shaft prior to fitting into door; Nov. 27, 1997; EPO; Derwent Abstract.*
(Continued)

*Primary Examiner* — Tahseen N Khan
(74) *Attorney, Agent, or Firm* — Kilpatrick Townsend & Stockton LLP

(57) ABSTRACT

The invention relates to an object comprising a relatively soft carrier material, optionally, an adhesive layer and/or an adhesive layer system, which are applied to the carrier material, and a relatively hard decorative layer. The object is characterized in that an intermediate layer is provided between the carrier material and the decorative layer and/or between the adhesive layer and the adhesive layer system and the decorative layer and comprises at least DLC (diamond like carbon) as the main component. The invention also relates to a method for producing said type of object.

18 Claims, 2 Drawing Sheets

Figure 1:
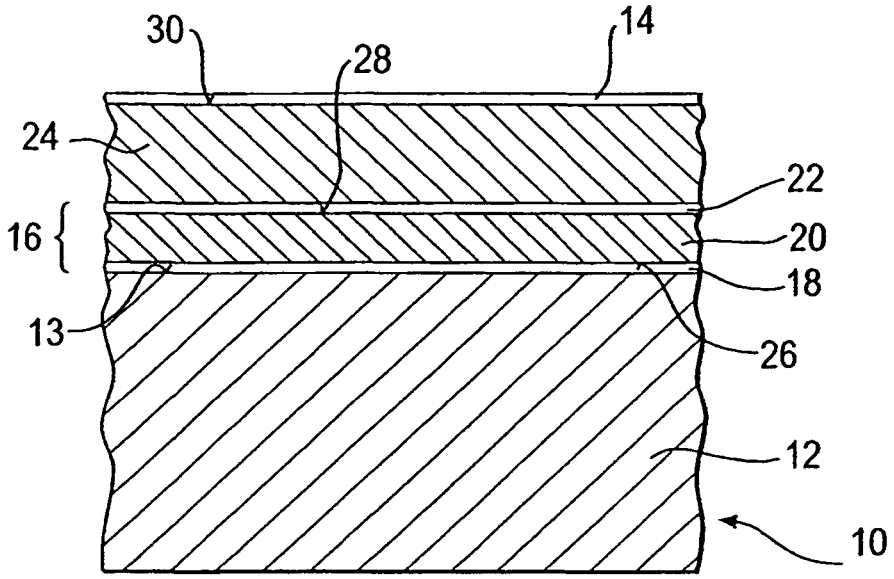

(52) U.S. Cl.
CPC ..... *C23C 28/343* (2013.01); *C23C 28/345* (2013.01); *C23C 28/347* (2013.01); *C23C 28/3455* (2013.01); *C23C 28/36* (2013.01); *Y10T 428/24802* (2015.01); *Y10T 428/24917* (2015.01)

(56) References Cited

U.S. PATENT DOCUMENTS

| | | | | |
|---|---|---|---|---|
| 2004/0131894 | A1* | 7/2004 | Erdemir et al. ..... | 428/698 |
| 2005/0196636 | A1 | 9/2005 | Kawakami et al. | |
| 2005/0242156 | A1* | 11/2005 | Jabs et al. ..... | 228/101 |

FOREIGN PATENT DOCUMENTS

| | | | |
|---|---|---|---|
| EP | 0 430 874 | A1 | 6/1991 |
| EP | 0 403 552 | B1 | 12/1994 |
| EP | 1 116 801 | B1 | 6/2004 |
| JP | 2004-10923 | A | 1/2004 |

OTHER PUBLICATIONS

Navinsek, P. Panjan, et al., "PVD Coatings as an Environmental Clean Alternative to Electroplating and Electroless Processes," vol. 116-119, pp. 476-487 (Sep. 1, 1999).

* cited by examiner

ARTICLE HAVING A RELATIVELY SOFT SUPPORT MATERIAL AND A RELATIVELY HARD DECORATIVE LAYER AND ALSO A METHOD FOR ITS MANUFACTURE

CROSS-REFERENCE TO RELATED APPLICATIONS

This application is a National Stage of International Application No. PCT/EP2007/000075, filed Jan. 5, 2007, and which claims the benefit of German Patent Applications Nos. 10 2006 001 860.5, filed Jan. 13, 2006, and 10 2006 002 034.0, filed Jan. 16, 2006, the disclosures of which applications are incorporated herein by reference.

The present invention relates to an article having a relatively soft support material, optionally a bond layer or a bond layer system applied to the support material and a relatively hard decorative layer. Furthermore the invention relates to a method for the manufacture of such an article. Such articles and corresponding methods are known per se, for example in the field of architectural fittings in which an article of brass, such as a door handle, is provided with a hard decorative coating, as is for example described in DE-A-1001 1597 of the present applicants.

In practice there is a multitude of further articles which are to be provided with a decorative layer. Examples are smaller articles in the field of consumer electronics such as in particular MP3 players, portable radios, mobile telephones etc. in which a plastic housing, which consists of the support material is to be provided with a coloured decorative layer, for example in an aluminium colour or in a black colour. Such articles with a housing of a soft metal such as aluminium, brass, stainless steel or the like are also known which are likewise to be equipped with a decorative layer. Even a support material of aluminium, brass, stainless steel or the like ultimatively represents a relatively soft support material, for example with a Vickers hardness $HV_{0.025}$ in the range from about 200 to about 300. Irrespective of whether such articles consist of plastic or of a relatively soft metal they show traces of use after a relatively short time, for example as a result of the frequent handling by the user or by the carrying of the corresponding article in a pocket or on a vibrating base, such as for example in a motor car.

The desire thus exists for a multitude of such articles, in particular articles of daily use, to provide the corresponding article with a decorative layer which is substantially more resistant to scratching and wearing of the decorative layer than hitherto.

The applicants are aware that the problem of the damage of the decorative layer, for decorative layers which are produced by PVD processes or CVD processes, is not to be sought in the composition of the layer itself, because such decorative layers are relatively thin and relatively hard, at least harder than the support material, but rather the problem has its origin in the relatively soft substrates, because these can relatively easily be scratched or otherwise damaged so that, for example, the soft support material is pressed in by the action of corresponding forces, which can lead to a deterioration of the appearance of a decorative layer or to local splitting off of this layer. The same problem arises with support materials of plastic.

Furthermore, it has been recognized in accordance with the invention that this problem can be overcome in that a relatively thick hard layer, for example of Cr is applied by means of a galvanic process to the article. For articles of aluminium or die cast zinc it is likewise known to provide a hard chrome layer by a galvanic route which additionally acts as a corrosion protection layer onto which the decorative layer can be applied. Such hard chrome layers have, however, the disadvantage that the corresponding galvanic baths contain chrome VI which is toxic and undesirable for health reasons.

For support materials of plastic it is known to apply galvanically a bond promoting layer system consisting of a first copper layer and a second nickel layer with a thickness of under 1 μm, with these being relatively soft layers. This bond promoting layer system is subsequently provided with a hard chrome layer with a thickness of about 10 to 20 μm before the actual decorative layer is applied.

For conductive articles it is, moreover, known to deposit a thin bond promoting layer with a thickness of less than 1 μm with a PVD process and then to apply a support layer of chrome or chrome nitride with a thickness of 1 to 3 μm onto this, likewise using a PVD process, before the actual decorative layer is deposited.

Apart from the problem of toxicity of hard chrome baths with chrome VI it is also disadvantageous that in all cases a Cr layer of a considerable thickness of several μm is required in order to provide good results. A relatively thick CR layer of this kind however requires a relatively long application time which makes the manufacturing process expensive. Furthermore, Cr is a relatively expensive material, above all when one is concerned with providing articles which are manufactured in large numbers with a correspondingly thick Cr layer.

After the application of such a hard layer which has an adequate thickness the danger of scratching or the danger of damaging the support material is considerably smaller and can be overcome in the so produced article consisting of a support material, a hard Cr layer and a decorative layer applied by means of a PVD or CVD process.

The object of the invention is thus to provide articles of a relatively soft support material and a decorative layer provided at the surface which is deposited by a PVD process or CVD process which have excellent resistance to scratching and wear, can also be manufactured at favourable costs and largely avoid problems of toxicity.

In order to satisfy this object an article of the initially named kind is provided in accordance with the invention which is characterized in that an intermediate layer is provided between the support material and the decorative layer, optionally between the bond layer or the bond layer system and the decorative layer, which consists of DLC, at least as the main component.

It has namely been found, in accordance with the invention, that an intermediate layer of this kind of which the main component consists of DLC is significantly harder than the relatively soft support material, and in comparison to a Cr layer, can be applied in a relatively short time and with significantly lower material costs but is nevertheless able to ensure an excellent resistance against scratching and wear of the article or of the PVD or CVD layer built up thereon, with relatively thin PVD or CVD layers in the range of 50 to 500 nm only being required and likewise being capable of being produced at relatively favourable cost.

Metals such as aluminium, brass, die cast zinc or stainless steel are to be understood amongst other things under the term "relatively soft support material" and, for example in the form of stainless steel, have a Vickers hardness $HV_{0.025}$ of 250. The soft support material generally has a $HV_{0.025}$ value below 300. This value should not be understood as a restriction because articles of materials with a higher HV value can likewise be successfully provided with a protective coating in accordance with the invention.

Articles of plastic support materials have in general a $HV_{0.025}$ value significantly under 250 $HV_{0.025}$ and can likewise be successfully provided with a coating in accordance with the invention.

For a support material of stainless steel, a stainless steel with 16 to 18% Cr and 8 to 12% Ni can be named as an example that only represents one example among a large diversity of metals.

For a support material of plastic this can be a single type of plastic or a mixture of different plastics.

The plastic can for example—without restriction—be selected from the group consisting of ABS, polycarbonate, PMMA, polypropylene, polystyrene, polyethylene, polyamide or synthetic resin or mixtures of the above-named plastics including plastics selected from one or more of the above-named plastics with fibre reinforcement.

It is not essential to provide a bond layer or a bond layer system between the support material and the intermediate layer, but rather the intermediate layer can in principle be deposited directly on the support material. Should bond problems arise which cannot be remedied by an etching process, or an etching and cleaning process, for the preparation of the surface of the support material to be coated, then a bond layer or a bond layer system can be used which is deposited on the cleaned and/or etched surface of the support material, with the intermediate layer then being deposited on the free surface of the bond layer of the bond layer system, optionally after further cleaning and/or etching.

In a preferred embodiment of the article or method of the invention which is best suited for a support material of stainless steel but also for plastic surfaces the bond layer consists of a Cr layer which merges with a reducing proportion of Cr and an increasing proportion of WC into the WC layer, which is subsequently provided with a W—C:H layer on which the intermediate layer with DLC as main component bonds. The bond layer of Cr is, in contrast to the prior art, not galvanically applied but rather by means of a PVD process. Thus, no problems arise which are to be attributed to chrome VI. Furthermore, the said applied Cr layer is relatively thin, for example under 50 nm, so that the treatment time in the vacuum chamber of the PVD plant is relatively short, which means that the manufacturing process which is carried out batch-wise is made substantially less expensive and the consumption of chrome is also lowered and thus the manufacturing costs drop for this reason.

Instead of a bond layer of pure chrome a layer of CrN can also be considered, for example a layer which is realized as a gradient layer in which the proportion of chrome is reduced within increasing layer thickness in favour of an increasing proportion of nitrogen. In this way the consumption of Cr can be reduced further and the layer becomes simultaneously significantly harder through the nitrogen that is incorporated.

In a further embodiment of the article of the invention and the method of the invention the bond layer consists of a Ti layer which merges with a reducing proportion of Ti and an increasing proportion of WC into a WC layer which is subsequently provided with a W—C:H layer on which the intermediate layer with DLC as the main component bonds. In this case also a TiN bond layer can be considered in place of a pure Ti bond layer.

In general the bond layer can consist of a metal layer which merges with a reducing proportion of metal and an increasing proportion of WC into a WC layer which is subsequently provided with a W:C—H layer on which the intermediate layer with DLC as the main component bonds, with the metal of the metal layer being able to be selected from the Group Cr, Ti, Al, Zr, V or combinations thereof.

With a support material of plastic a CuNi layer sequence can be applied galvanically as a bond layer system in a manner known per se.

Furthermore the possibility exists of using polymeric bond layer systems which are known per se and can be applied in a PAVCD process onto a support material using organo-silicon compounds, which can be introduced into the corresponding vacuum plant in gas form or in liquid form. One example is HDSMO (hexadimethyldisiloxane) which is converted in the plasma by cracking into silicon and hydrocarbon containing compounds which are deposited as a polymer layer on the article which forms the bond layer. By increasing the proportion of oxygen in the gas atmosphere of the plant this well adhering but somewhat soft layer can advantageously be changed in the direction of a glass-like layer consisting of $SiO_2$ which signifies an advantageous and significant increase of the layer hardness.

A multitude of possibilities exists for realizing decorative layers which are to be applied to the free surface of the intermediate layer of which some examples—without restriction—will be named in more detail in the following. By way of example the decorative layer applied by means of PVD and/or CVD in accordance with the invention can be a black layer of non-reactively applied Ti with a reactively applied coating of TiCrCN.

In accordance with a further alternative in accordance with the invention the decorative layer can be a ZrCN layer with a brass, gold, nickel or bronze colour deposited by means of PVD.

In accordance with another alternative in accordance with the invention the decorative layer can be a TiCN layer with a gold, stainless steel, bronze or copper colour.

A further alternative in accordance with the invention consists in realizing the decorative layer by a CrCN layer with a stainless steel colour and deposited by means of PVD.

Furthermore, the possibility exists in accordance with the invention of realizing the decorative layer by a ZrCrCN layer with an anthracite colour and deposited by means of PVD.

Furthermore, the possibility exists of using coloured oxide or oxynitride layers which are deposited by means of PVD processes as decorative layers and which have rainbow colours such as blue, green etc. Such layers consist for example of TiCrO, TiCrON, TiON, CrON.

With such decorative layers layer thicknesses of approximately 50 to 500 nm are usually used.

The method in accordance with the invention which is described in more detail in the claims is preferably carried out in a plant having at least one sputter target for the deposition of any bond layer or of any bond layer system and/or components of the decorative layer, a PACVD system for the application of the intermediate layer with DLC as the main component or exclusive component and with at least one arc source for the application of any bond layer or any bond layer system and/or components of the decorative layer.

Figure 2:
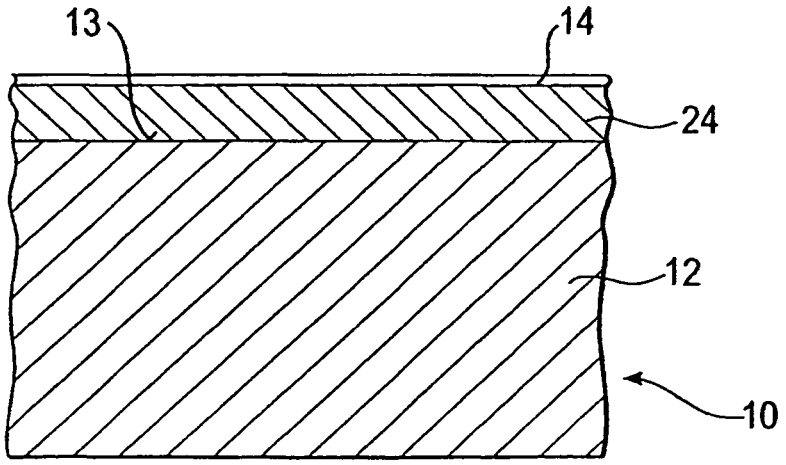
Figure 3:
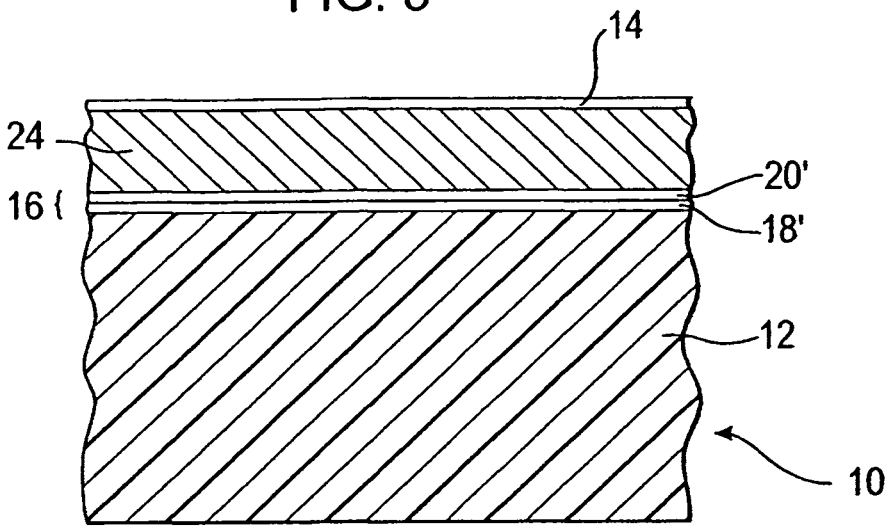
Figure 4:
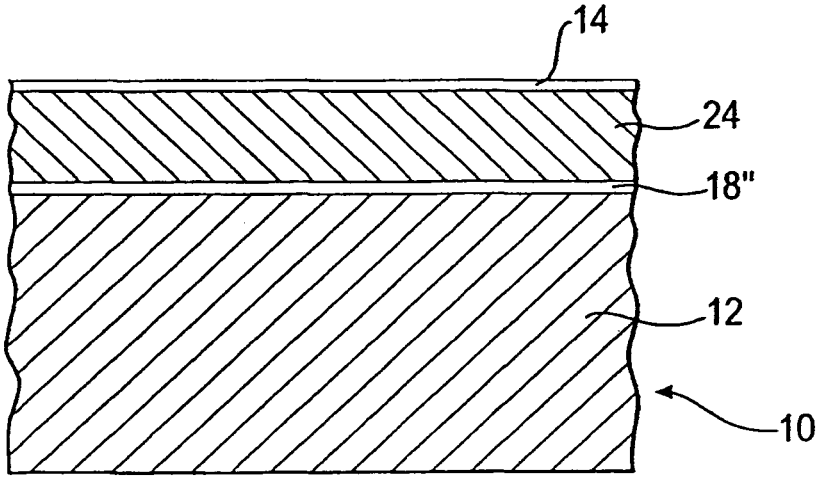

The invention will now be described in the following with reference to embodiments and to the drawings in which:

FIG. 1 shows a cross-section of an article and the layers applied to this article, FIG. 2 shows a cross-section from a further article in accordance with the invention and the layers applied to this article, and FIGS. 3 and 4 show two further examples of layer systems which can be used in accordance with the invention on support materials of plastic (or metal).

FIG. 1 shows first of all a cross-section through an article 10 of any desired kind which consists of a support material 12 and a decorative coating 14. In this example a bond layer system 16, which consists of a base layer 18, a transition layer 20 and a cover layer 22, is present on the originally free surface 13 of the support material 12 of the article.

Between the cover layer 22 and the decorative layer 14 there is an intermediate layer 24 which in this example is a DLC layer, i.e. a layer which, apart from impurities, which are to be avoided as far as possible, consists of DLC (Diamond-Like Carbon).

The individual components of this example will now be explained in more detail.

The support material 12 is, in this example, either a metal such as, for example, stainless steel or a plastic such as, for example, ABS. Stainless steel has a Vickers hardness of 250 $HV_{0.025}$ and consequently counts as relatively soft. In particular the present invention is concerned with relatively soft support materials with hardnesses which normally lie below 300 $HV_{0.025}$, however the invention can also be used with harder support materials and these hardness details should not be understood as a restriction.

When the support material 12 of the article 10 is realized of plastic, for example ABS, then the Vickers hardness lies significantly below 250 $HV_{0.025}$.

For the application of the layers 18, 20, 22, 24 and 14 the article 10 is inserted into a flexible vacuum coating plant which is preferably able to apply coatings by magnetron sputtering and by PACVD (Plasma Assisted Chemical Vapour Deposition) with the plant preferably also being able to likewise apply coatings to articles by means of arc vaporization using arc sources by corresponding PVD processes. A plant of this kind could for example be a Hauzer Flexicoat plant which is supplemented with a PACVD system. Hauzer Flexicoat plants are for example protected by the European patent EP 403552.

After the introduction of the article 10 into the flexible vacuum coating plant the article is first heated up to operating temperature by heating up of the plant in a manner known per se, with simultaneous evacuation of the chamber, whereby volatile components which are to be understood as contaminants in the article are largely removed from it. They are sucked off via the vacuum system of the flexible vacuum coating plant. After achieving the appropriate operating temperature, which is different for plastics and metals, but is in practise well known as specific to the material, the targets, i.e. the sputtering cathodes, which deliver the materials for the layers 18, 20, 22 and 14, are cleaned. This takes place for example in that the targets are operated in sputter operation and with an inert gas atmosphere in the flexible vacuum coating plant with a closed shutter whereby the sputtered initially contaminated surface material of the target is deposited on the shutter. In this way the contaminations are removed from the surfaces of the targets, for example contaminations from an earlier coating process, so that the targets have the required purity. Thereafter an etching process is carried over a period of time using a plasma source which is incorporated into the flexible vacuum coating plant. Such plasma sources are well known per se and frequently operated in pulse operation because this brings practical advantages. During this etching process the free surface 13 of the support material 12 is etched and cleaned in order to achieve a good adhesion of the bond layer system 16.

After the cleaning of the surface 13, the thin layer 18 of Cr with a thickness in the range from 50 to 500 nm is deposited on the surface of the article 10 by PVD. This is advantageous in an article of stainless steel since Cr is in any event contained in the stainless steel and in this manner a qualitatively high grade transition between the support material 12 and the bond layer 18 is ensured, which is good for the adhesion.

In an article of plastic the application of the Cr layer offers the possibility of achieving a conductive layer on the plastic article which is useful for the further process. The application of the Cr layer to a plastic article is for example described in the European patent specification 1116801.

This Cr layer 18 can result from a magnetic sputtering process from a sputter source, i.e. a target of Cr, or could result with an arc coating process from a corresponding target as an arc source.

The transition layer 20 consists of a mixture of Cr and WC, with the proportion of Cr gradually being reduced to zero starting from a maximum value at the surface of layer 18 and going towards the boundary surface 28, whereas the proportion of WC is increasingly raised so that at the free surface of the transition layer 20 there is at least substantially no longer any Cr present and the free surface consists essentially of a WC layer. This transition layer 20 is likewise relatively thin, but thicker than the bond layer 18 and is terminated by the cover layer 22, which is in this example represents a W—C:H layer.

WC for the transition layer 20 is produced from a target of WC which is operated as a sputter source.

In order to produce the cover layer 22 of W—C:H the previous atmosphere of the flexible vacuum coating plant of argon is partly replaced by the supply of acetylene $C_2H_2$ and this leads to the WC layer now containing an excess of carbon and being modified by the hydrogen that is present. In this way a so-called W—C:H layer arises. After producing the likewise very thin cover layer 22 the operating mode of the flexible vacuum coating plant is switched over to PAVCD and then, in a manner known per se, a DLC layer 24 is produced which can for example be ca. 2 μm thick. This thickness value does not however represent any form of restriction of the invention—the layer could also be thinner or thicker without departing from the scope of the teaching of the invention.

In this example the intermediate layer 24 consists exclusively of DLC (apart from the customary unavoidable contaminants) and is produced from the supplied acetylene, i.e. from the atmosphere of the flexible vacuum coating plant.

Although in this example the intermediate layer 24 is pure DLC, it is also entirely conceivable that DLC only forms a component of the intermediate layer 24. For example, other components such as for example silicon could be co-deposited, which as a rule originates from a gas atmosphere of the plant but could also originate from the corresponding target, either by a magnetron sputtering process or by an arc process. Normally DLC forms the main component of the intermediate layer 24.

Finally, a thinner decorative layer 14 of for example 50 to 500 nm thickness is deposited on the free surface 30 of the intermediate layer 24. The decorative layer 14 could be any desired decorative layer which can be deposited by means of a PVD or CVD process. Examples for such layers and the colours which can be produced thereby are sufficiently known in the prior art and some coatings preferred in accordance with the invention are set forth in the patent claims 10 to 13.

In the example of claim 10, a TiCrCN coating is applied and indeed the first layer Ti which is deposited in a non-reactive manner of operation and indeed either by magnetron sputtering from a corresponding Ti target or by an arc process from a corresponding target, without a chemical reaction with the atmosphere of the chamber taking place. For this purpose the atmosphere of the chamber must be formed by an inert gas such as for example Ar.

Finally, the TiCrCN layer is produced. For this purpose targets of Ti and Cr are used and the atmosphere of the chamber is changed so that it is formed by gases which deliver carbon and nitrogen, for example a mixture of acetylene and nitrogen.

The application of the further coatings of the claims 11 to 14 takes place analogously except that for the layers quoted there it is not necessary to first deposit a metallic layer of Ti with a non-reactive process but rather the corresponding compounds can be produced reactively from corresponding targets and gases.

It is not essential to use a bond system such as 16 but rather one can completely omit this bond layer system if an adequate bond can be achieved by the preparation of the surface of the article (cleaning and/or etching) or a single bond layer of a suitable material can be used instead of the bond layer system.

In the embodiment of FIG. 2 a structure is produced which is very similar to that of FIG. 1 except that here the bond layer system 16 is omitted, i.e. the intermediate layer 24 is deposited directly onto the free surface 13 of the article and is also directly followed by the decorative layer 14.

In the illustration of FIG. 3 an article 10 of plastic is shown which has a bond layer 16 consisting of the here galvanically applied layers 18' and 20', with the layer 18' consisting of Cu and the layer 20' of Ni.

Furthermore, in FIG. 4 an article is shown with a bond layer 18" which consists of a polymer layer, for example of a polymer layer which, as explained above, is produced from HDMSO by means of a PACVD process.

In the illustrations in accordance with FIGS. 2, 3 and 4 the same reference numerals are used as in FIG. 1 and the corresponding explanations apply in just the same way for the components of these Figures and will not repeated here.

The invention claimed is:

1. An article having a relatively soft support material with a Vickers hardness ($HV_{0.025}$) of below 300, a bond layer or a bond layer system applied to the support material, and a relatively hard decorative layer having a hardness greater than the hardness of the support material, wherein an intermediate layer which contains DLC, at least as a main component, is provided between the or the bond layer system and the decorative layer, the bond layer consisting of a metal layer which merges with a reducing proportion of metal and an increasing proportion of WC into a WC layer which is subsequently provided with a W—C:H layer on which the intermediate layer with the main component DLC bonds and with the metal of the metal layer being selected from the group comprising Cr, Ti, Al, Zr, V or combinations thereof.

2. An article in accordance with claim 1, wherein the support material is selected from a group consisting of aluminium, brass, magnesium and stainless steel.

3. An article in accordance with claim 1, wherein the bond layer consists of a Cr layer which merges with a reducing proportion of Cr and increasing proportion of WC into a WC layer which is subsequently provided with a W—C:H layer on which the intermediate layer with the main component DLC bonds.

4. An article in accordance with claim 1, wherein the bond layer consists of a CrN layer, optionally in the form of a gradient CrN layer with a reducing proportion of Cr and an increasing proportion of N, which gradually merges into a WC layer, with the proportion of WC increasing in the direction away from the CrN layer and the WC layer subsequently being provided with a W—C:H layer on which the intermediate layer with the main component DLC bonds.

5. An article in accordance with claim 1, wherein the bond layer consists of a Ti layer which merges with a reducing proportion of Ti and an increasing proportion of WC into a WC layer which is subsequently provided with a W—C:H layer on which the intermediate layer with the main component DLC bonds.

6. An article in accordance with claim 1, wherein the bond layer is an organo-silicon layer which is for example deposited by means of a PACVD process onto a support material of plastic or metal.

7. An article in accordance with claim 1, wherein the bond layer is a CuNi layer sequence which is deposited galvanically onto a support material of plastic or metal.

8. An article in accordance with claim 1, wherein the decorative layer applied by means of PVD and/or CVD is a black layer of non-reactively applied Ti with a reactively attached coating of TiCrCN.

9. An article in accordance with claim 1, wherein the decorative layer is a ZrCN layer deposited by means of PVD with a brass, gold, nickel or bronze colour.

10. An article in accordance with claim 1, wherein the decorative layer is a TiCN layer with a gold, stainless steel, bronze or copper colour.

11. An article in accordance with claim 1, wherein the decorative layer is a CrCN layer deposited by means of PVD with a stainless steel colour.

12. An article in accordance with claim 1, wherein the decorative layer is a ZrCrCN layer deposited by means of PVD with an anthracite colour.

13. An article in accordance with claim 1, wherein the support material consists of a metal or a metal alloy.

14. An article in accordance with claim 13, wherein the metal is stainless steel with 16 to 18% Cr and 8 to 12% Ni.

15. An article in accordance with claim 1, wherein the support material consists of at least one plastic.

16. An article in accordance with claim 15, wherein the plastic is selected from the group consisting of ABS, polycarbonate, PMMA, polypropylene, polystyrene, polyethylene, polyamide or synthetic resin or mixtures of the above-named plastics including one or more of the above-named plastics with fibre reinforcement.

17. An article in accordance with claim 1, wherein the decorative layer is an oxide or oxynitride layer having a rainbow colour such as blue or green deposited by means of PVD.

18. An article in accordance with claim 17, wherein the oxide or oxynitride layer is an oxide or oxynitride of a metal of the group Ti, Cr or a combination of these metals.

* * * * *